US005868439A

United States Patent [19]

Schmidt

[11] Patent Number: 5,868,439

[45] Date of Patent: Feb. 9, 1999

[54] DISTRIBUTION HEADER FOR POTABLE WATER AND HOT WATER SPACE HEATING

[76] Inventor: Garry Schmidt, 4, 3850-19 NE, Calgary AB, Canada, T2E 6V2

[21] Appl. No.: 886,526

[22] Filed: Jul. 2, 1997

[51] Int. Cl.[6] ..... F16L 43/00

[52] U.S. Cl. ..... 285/127.2; 137/798; 248/74.2; 285/61; 285/238; 285/394

[58] Field of Search ..... 137/317, 798; 285/61, 64, 92, 125.1, 129.1, 130.1, 133.11, 133.3, 133.4, 238, 239, 127.2, 148.23, 148.18, 132, 138, 903, 41, 394, 425; 248/74.1, 74.2

[56] References Cited

U.S. PATENT DOCUMENTS

| | | | |
|---|---|---|---|
| 206,932 | 8/1878 | Conkle | 285/394 X |
| 760,682 | 5/1904 | Card | 285/61 |
| 1,224,269 | 5/1917 | Broadbent | 285/394 X |
| 3,719,205 | 3/1973 | Harris | 137/798 X |
| 4,230,347 | 10/1980 | Williams | 285/125.1 X |
| 5,277,456 | 1/1994 | Mer et al. | 285/148.13 X |
| 5,279,319 | 1/1994 | Fidelman | 137/798 X |
| 5,572,776 | 11/1996 | Murphy et al. | 248/74.2 X |

FOREIGN PATENT DOCUMENTS

| | | | |
|---|---|---|---|
| 3019303 A | 11/1981 | Germany | 248/74.2 |

OTHER PUBLICATIONS

GRA–TEC Inc., Fitting Catalog, Los Altos, California, pp. 4,5 & 10, Apr. 1968.

*Primary Examiner*—Anthony Knight
*Assistant Examiner*—Greg Binda
*Attorney, Agent, or Firm*—David S. Thompson

[57] ABSTRACT

A water manifold is usable in the construction of a fluid-based heat-transfer system for space heating, the supply and distribution of potable water, and other applications. The water manifold is formed from a number of elements in a flexible manner, in that the elements are assembled as needed for a particular application. A plurality of manifold segments 100, each supporting a pipe directed away from a main pipe, transfer heat to a specific area, and may be be connected in a linear manner, as required by the design of the application. A cross tee segment 300 is attachable to the manifold segments, and may be used to support a thermometer unit 200, an automatic air vent or other apparatus. A spigot 400 is attachable to the cross tee segment, adjacent to the thermometer. An open end cap 500 provides a male plastic fitting connected to a brass female fitting, thereby allowing connection of the manifold to metal plumbing. A closed end cap 600 allows the manifold to be terminated. A support bracket 700 is adapted to connect to the manifold segments for support.

5 Claims, 6 Drawing Sheets

DISTRIBUTION HEADER FOR POTABLE WATER AND HOT WATER SPACE HEATING

CROSS-REFERENCES

There are no applications related to this application filed in this or any foreign country.

BACKGROUND

It has long been known to use hot water or steam to transfer heat in space heating applications. Modern hot water heating systems have many advantages, including the ability to control the temperature of different rooms individually and the ability to use any of a variety of efficient central heat sources. Such heating systems typically warm the floor; however, wall or ceiling based heat may also be used.

In typical modern hot water heating systems, water manifolds allow regulation of water flow through pipes separating from the main line, thereby allowing better control over the fluid flow rate and heat transfer to specific areas. Such manifolds are typically assembled from cylindrical tubular pieces that are held in place by rods that must be custom manufactured and assembled for installation. The rod is inserted into and through channels defined in the manifold components. As a result, the cost of both the components and their assembly is greatly increased. In many applications this can be a significant obstacle to the use of a hot water space heating system.

For the foregoing reasons, there is a need for a hot water space heating system having a manifold that can be manually assembled without the use of connecting rods, extensive tools, and that does not require components defining the channels associated with the rod assembly technique.

SUMMARY

The present invention is directed to an apparatus that satisfies the above needs. A novel distribution header for potable water and hot water space heating uses provides some or all of the following structures.

(A) An open ended cap is formed from combined brass and plastic bodies, and provides a transition between metallic pipe and plastic manifold segments. The brass body is typically internally threaded and provides external anchoring ribs, to which a plastic body portion attaches. The plastic body portion typically provides external threads having a locking rim and locking stop which control the degree of rotation with respect to an adjacent threaded plastic component.

(B) At least one manifold segment is used, each provides a tubular body having oppositely directed male and female threaded connector ends. Each threaded end provides a locking rim and a locking stop which controls the degree of rotation with respect to an adjacent threaded component. Each manifold segment additionally provides an upper female threaded connector and a lower male threaded connector, each oriented perpendicularly to the tubular body. In a typical embodiment of the invention, the upper female threaded connector would carry a balancing head having a downwardly directed balancing shaft which could regulate fluid flow out of the lower connector, thereby controlling heat transfer to the zone.

The tubular body of each manifold segment additionally carries on its outer surface upper and lower rails, as well as a pair of parallel side rails on each side. The rails are adapted to conform to a bracket for support of the entire manifold.

(C) A cross tee pipe segment provides a tubular body having oppositely directed male and female threaded connector ends, each having a locking rim and a locking stop which controls the degree of rotation with respect to an adjacent threaded component. Four female threaded sockets are radially arrayed about the tubular body, perpendicular to its length.

(D) A thermometer unit provides a thermometer having a face and rearwardly extending probe. The probe is carried by a peripherally defined thermometer socket threadedly connectable to one of the four female threaded sockets of the cross tee segment.

(E) A spigot, carried adjacent to the thermometer unit by a threaded socket on the cross tee segment, allows removal of fluid of a known temperature.

(F) A supporting bracket, carried by a supporting wall, is adapted to grasp one or more of the rails defined in the outer surface of the manifold segment, thereby supporting the manifold.

It is therefore a primary advantage of the present invention to provide a novel distribution header for potable water and hot water space heating, adapted primarily to heat transfer for space heating, having a novel open ended cap that is formed from both brass and plastic bodies, thereby providing a transition between metallic pipe and plastic manifold segments.

Another advantage of the present invention is to provide a novel distribution header adapted primarily to heat transfer for space heating, wherein the brass body of the open ended cap provides anchoring ribs encased by the plastic body, thereby securely connecting the brass and plastic bodies.

Another advantage of the present invention is to provide a novel distribution header adapted primarily to heat transfer for space heating, wherein the manifold includes at least one manifold segment defining at least one rail on its outer surface for attachment to a supporting bracket.

Another advantage of the present invention is to provide a novel distribution header having a narrow structure suitable for mounting within a wall. A related advantage is that the manifold segments provide vertically oriented upper and lower male and female connectors, thereby better adapting the manifold to fit within a narrow space between adjacent walls.

Another advantage of the present invention is to provide a novel water manifold segment, cross tee segment, open-ended cap and closed end cap all of which provide a novel locking rim and locking stop which prevent over- or under-rotation, thereby aligning each segment with adjacent segments.

A still further advantage of the present invention is to provide a novel distribution header for potable water and hot water space heating having a novel cross tee segment supporting a thermometer and associated thermometer socket, while also supporting a spigot having a threaded spout and an associated valve.

A still further advantage of the present invention is to provide a novel distribution header for potable water and hot water space heating having a novel bracket adapted to engage rails formed in the surface of the water manifold segment.

A still further advantage of the present invention is to provide a plurality of interlocking components from which a novel distribution header may be assembled in a manner that is suited to the requirements of a specific application.

DRAWINGS

These and other features, aspects, and advantages of the present invention will become better understood with regard to the following description, appended claims, and accompanying drawings where:

DESCRIPTION

Figure 2:
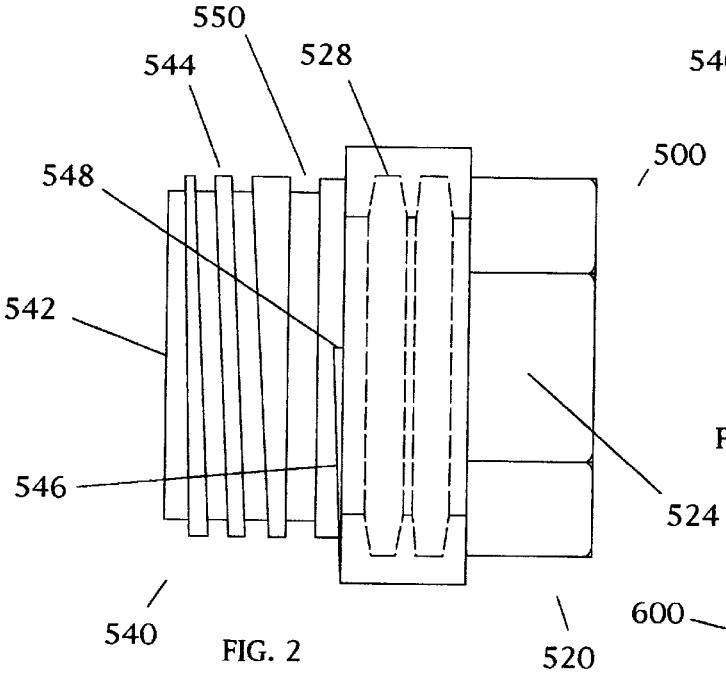
FIG. 2 is an enlarged side view of the open end cap of FIG. 1, with the brass portion carried within the plastic portion shown in dotted outline.

A distribution header, or water manifold, for potable water distribution and hot water space heating is disclosed. The water manifold is formed from a number of elements in a flexible manner, in that the elements are assembled in a quantity and arrangement required by the needs of a particular application. A plurality of manifold segments 100, each supporting a pipe directed away from the main pipe for transferring heat to a specific area, may be be connected in a linear manner, as required by the design of the application. A cross tee segment 300 is attachable to the manifold segments, and may be used to support a thermometer unit 200, an automatic air vent or other apparatus. A spigot 400 is attachable to the cross tee segment, adjacent to the thermometer. An open end cap 500 provides a male plastic fitting and a brass female fitting, thereby allowing connection of the manifold to metal plumbing. A closed end cap 600 allows the manifold to be terminated. A support bracket 700 is adapted to connect to the manifold segments for support, as will be seen.

A manifold segment 100 constructed in accordance with the principles of the invention is seen in FIGS. 7–10. Typically, each manifold segment is associated with a zone to be heated or with the supply of potable water. Where a zone is to be heated, the zone is often a single room or portion of a larger room; however, a zone could be more than one room. Where potable water is being delivered, each manifold segment is associated with a location to which the water is delivered. A plurality of similar manifold segments, joined end-to-end in a linear manner, allows heated fluid carried within the flow channel 112 to be directed through the fluid channel 186 defined in the lower male connector 180 carried by each manifold segment. In this manner, heat transfer to a zone controlled by each manifold segment may be regulated.

Figure 7:
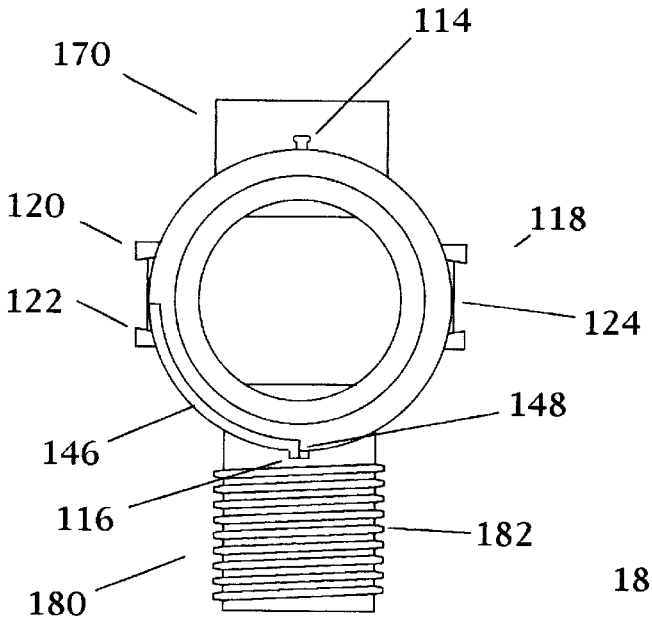
FIG. 7 is end view of the manifold segment of FIG. 6.
Figure 8:
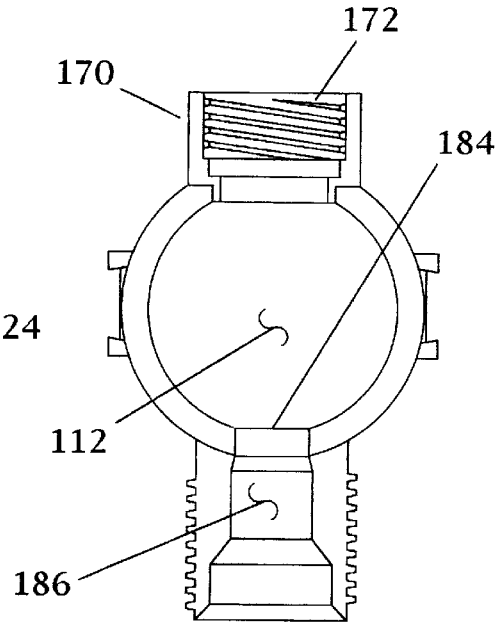
FIG. 8 is a cross-sectional view of the manifold segment of FIG. 7.
Figure 9:
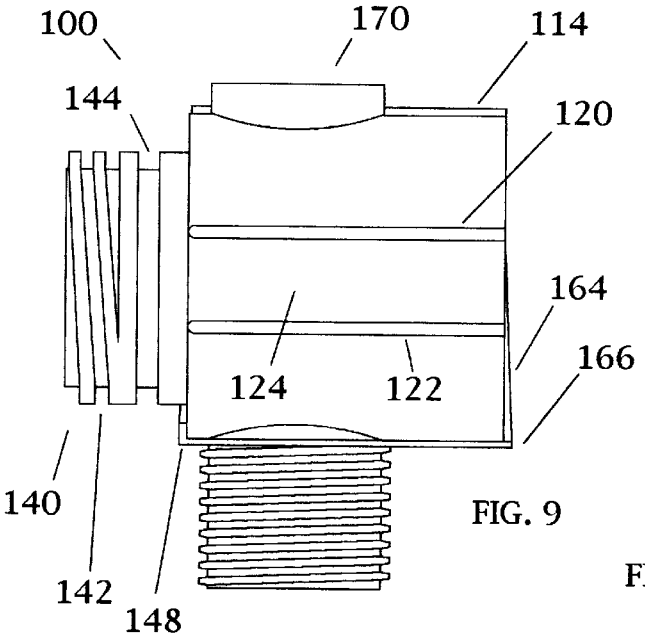
FIG. 9 is a side view of the manifold segment of FIG. 7.

Referring in particular to the end- and side-views of FIGS. 7 and 9, each manifold segment provides a tubular body 110 defining an interior flow channel 112. An upper rail 114 and a lower rail 116 allow connection of the manifold segment 100 to the support bracket 700. The terminology upper and lower is somewhat arbitrary, in that either rail 114, 116 could be oriented upwardly, depending on the application. A side rail pair 118 includes an upper side rail 120 and a lower side rail 122. The side rail pair is adapted to fit into the notch 714 and adjacent to the shoulder 716 of the support bracket 700. A flat area 124 is defined in the area between the upper and lower side rails.

Figure 10:
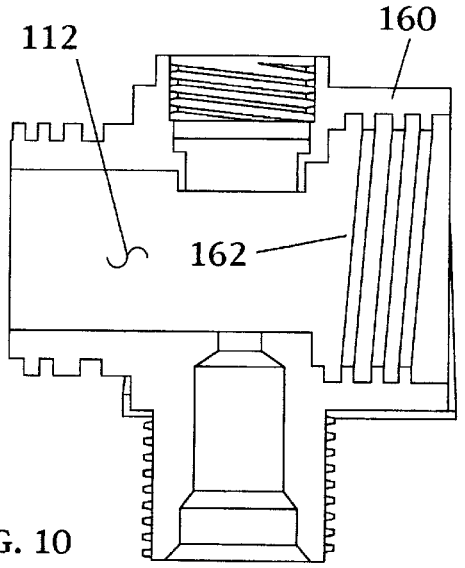
FIG. 10 is a cross-sectional side view of the manifold segment of FIG. 7.

Referring in particular to the side and cross-sectional views of FIGS. 9 and 10, it can be seen that a male connector end 140 allows attachment to the female connector end 160 of a similar manifold segment 100, the cross tee segment 300 or closed end cap 600. The male connector end provides external threads 142 which may be of several types. In a preferred version of the invention, the external threads 142 are sized to result in 360 degree rotation with respect to the female connector 180 of a similar manifold segment, cross tee segment or closed end cap. As a result of the 360 degree rotation, the orientation of the manifold segment after attachment can easily be predicted prior to attachment.

However, in alternative embodiments of the invention, the external threads 142 may be sized to result in attachment after either one-half or one-quarter rotation. In any embodiment, the female internal threads 172, 322 or 614 are sized appropriately in relation to the male threads.

Figure 17:
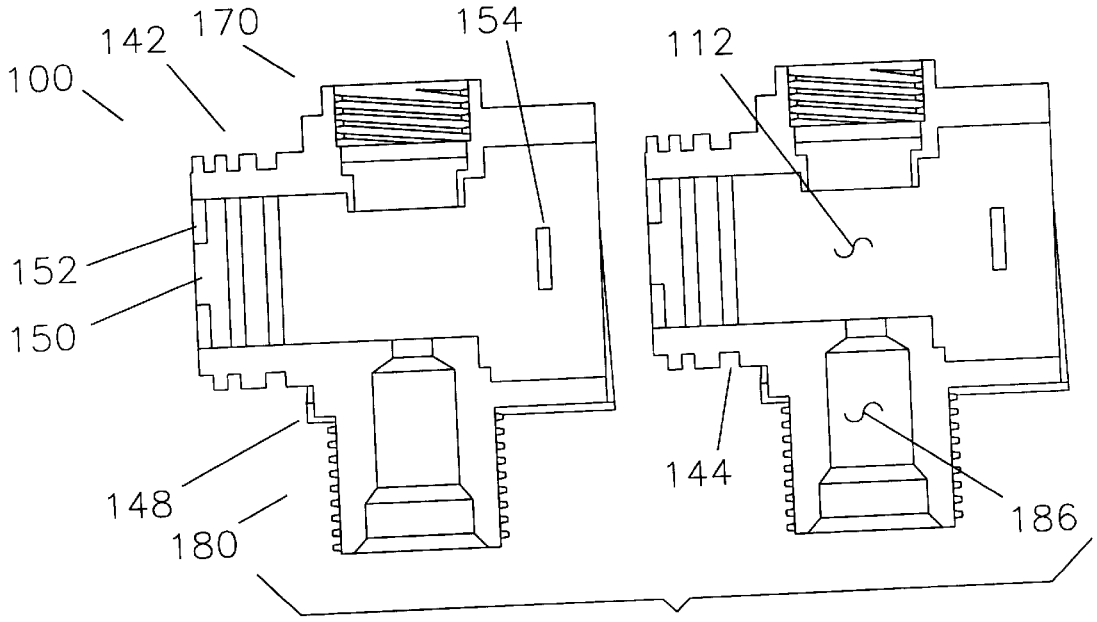
FIG. 17 is a second version of the manifold segment of FIG. 7, having a fastening structure that is an alternative to the threaded connection of FIG. 7.

In a still further alternative embodiment of the invention, as seen in FIG. 17, a notch 150 in an internal rib 152 in the male connector end 140 is sized to engage a locking tab 154 carried by the female connector end 160. In a manner easily understood by inspection of FIG. 17, two similar manifold segments could be inserted together, and thereby be joined without rotation.

Figure 18:
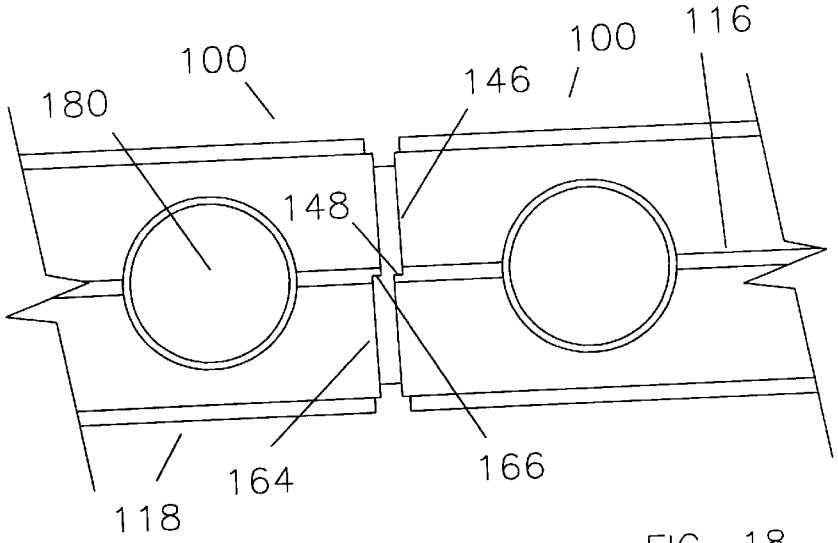
FIG. 18 is a bottom view of two manifold segments, slightly separated, better illustrating the locking rim and locking stop structures.

Referring again to FIGS. 9 and 10, an O-ring slot 144 is sized to carry an O-ring (not shown) which forms a fluid-tight seal with an adjacent manifold segment. A locking rim 146 and a locking stop 148 are best seen in FIGS. 7, 9 and 18. The locking rim 146 tapers gradually from a maximum thickness of approximately 1/16" (see FIG. 9) over approximately 90 degrees (see FIG. 7). The locking stop 148 of a first manifold segment engages the locking stop 166 of a second manifold segment, thereby preventing further rotation, and stopping rotation when the adjacent manifold segments are similarly oriented.

Referring to FIG. 18, two adjacent manifold segments are positioned prior to rotation. As a result, adjacent locking stops and locking rims are separated slightly, thereby providing a better view of their construction.

Referring again to FIGS. 9 and 10, the female connector ends 160 may be seen. Internal threads 162 are appropriately sized to match the male threads 142 of an adjacent manifold segment. A locking rim 164 and locking stop 166 are sized to engage the locking rim 146 and locking stop 148 of the male connector end.

Referring to FIGS. 6–10, an upper female connector 170 provides internal threads 172 sized to support a shut-off head 174 of known design. The shut-off head provides a shut-off shaft 176 and associated gasket 178 that regulates flow through the fluid channel 186 of the lower male connector 180. In hot water space heating applications, the shut-off shaft 176 is typically driven by a drive motor. In systems supplying and distributing potable water, the shut-off shaft 176 is typically manually operated.

Continuing to refer to FIGS. 6–10, in a preferred application, a lower male connector 180 may be attached by external threads 182 to tube or pipe associated with a space heating zone. Heat transfer is accomplished by fluid flow through orifice 184 and channel 186.

Figure 11:
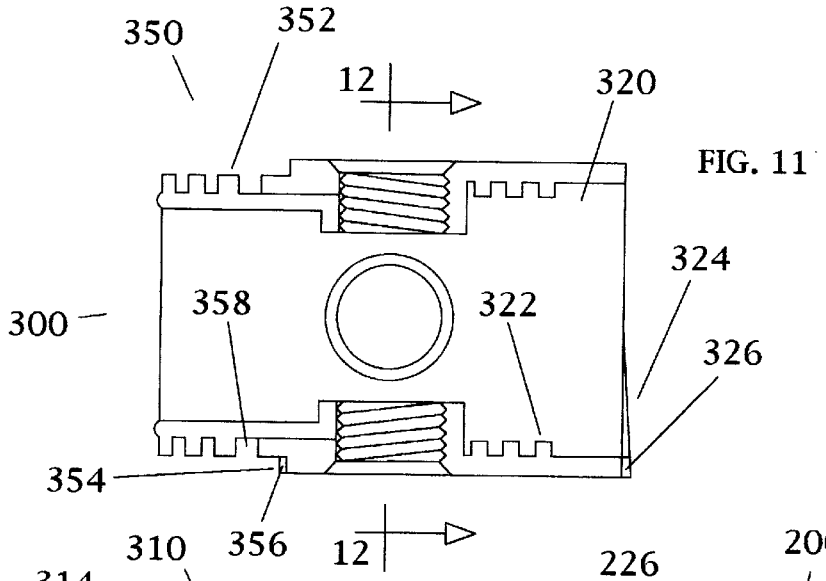
FIG. 11 is a side cross-sectional view of a version of the cross tee segment of the invention.
Figure 12:
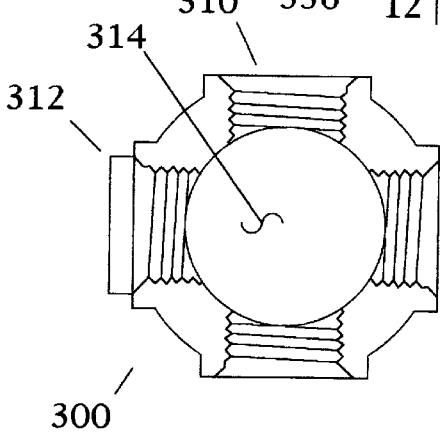
FIG. 12 is a cross-sectional view of the cross tee segment of FIG. 11, taken along the 12—12 lines, with a socket plug added to one threaded attachment fitting.

A cross tee segment 300, seen in FIGS. 11 and 12, is attachable to a manifold segment 100. The cross tee segment provides four radially arrayed threaded attachment fittings such as female threaded sockets 310, which may be sealed by socket plugs 312 or a cap. The cross tee defines a flow channel 314 that is similar in size to the flow channel 112 of the manifold segments.

A female coupling 320 is attachable to the male connector end 140 of a manifold segment 100. The coupling provides threads 322 a locking rim 324 and locking stop 326 are similar in structure to the corresponding structures of the manifold segments.

A male coupling 350 is oriented in an opposite direction from the female coupling, and also provides threads 352, a locking rim 354 and a locking stop 356 sized to engage the similar structures in the female connector end 160 of a manifold segment or female coupling 320 of an adjacent cross tee segment. An O-ring slot 358 carries an O-ring (not shown).

Figure 13:
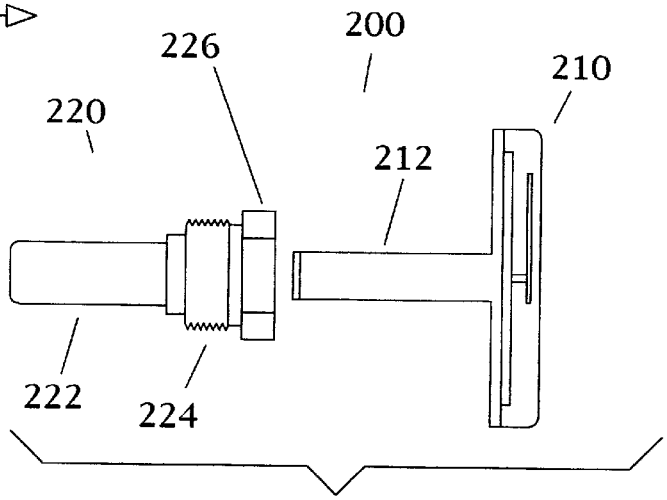
FIG. 13 is an exploded side view of a version of the thermometer and thermometer socket of the invention.

Referring to FIG. 13, a thermometer unit 200 provides a face plate 210 and a cylindrical probe 212. A thermometer socket 220 is sized to protect the thermometer probe, and is insertable within the one of the threaded sockets 310 of the cross tee 300. The thermometer socket provides a tubular body 222 which when installed extends into the flow channel 314 of the cross tee 300. Fastening threads 224 and an integral nut 226 allow the thermometer socket to be attached to the cross tee.

A spigot 400 is also insertable into one the threaded sockets 310 of the cross tee pipe segment 300. The spigot of the preferred embodiment provides an upper threaded fastener 410 sized to fit a threaded socket 310. A valve 412 is controlled by a lower knob 414. A threaded spout 416 is covered by cap 418 when not in use.

Figure 1:
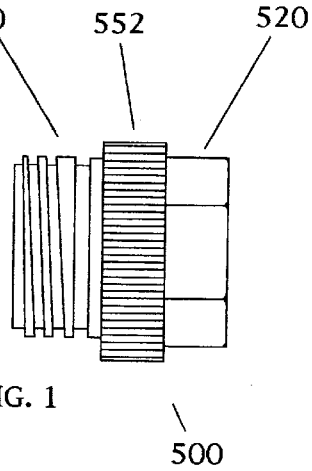
FIG. 1 is a side view of a version of the open end cap of the invention.
Figure 3:
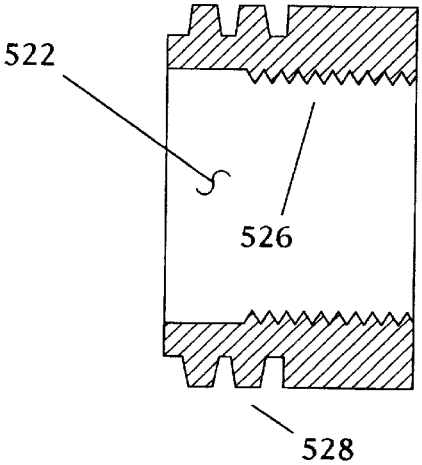
FIG. 3 is a cross-sectional view of the brass portion of the open end cap of FIG. 1.

Referring to FIGS. 1–3, an open end cap 500 is formed from a brass body 520 joined to a plastic body 540. The brass body, defining a flow channel 522, is best seen in FIGS. 2 and 3. The brass body allows attachment to metal pipes without damage, and may alternatively be made of any suitable metal. A hex sided surface 524 allows attachment by a wrench or other tool. Internal threads 526 allow the open end cap to be attached to metal pipes without damage. Anchoring ribs 528 allow the brass body to be firmly attached to the plastic body.

A plastic body 540 defines a flow channel 542 within a tubular body having external threading 544. The plastic body encloses the anchoring ribs 528 thereby securely connecting the plastic and brass bodies. A locking rim 546 and locking stop 548 are similar to those found on the manifold segments, and are sized to engage the locking rims and locking stops of the manifold segments or cross tee. An O-ring slot 550 supports an O-ring (not shown) for a fluid-tight seal. An annular grip 552, having a frictional surface, allows a user to hand-tighten the open end cap to plastic parts, such as the manifold segments or cross tee.

Figure 4:
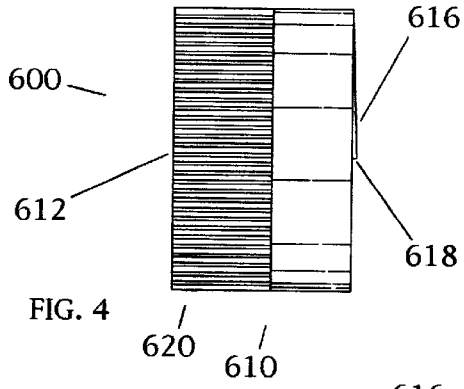
FIG. 4 is a side view of a version of the end cap associated with the invention.
Figure 5:
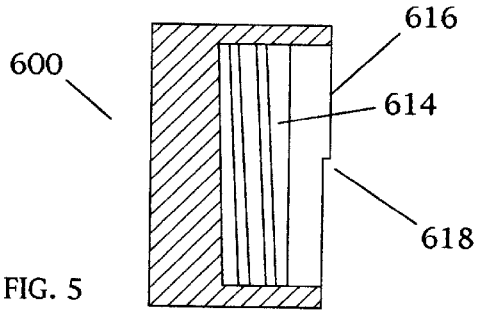
FIG. 5 is a cross-sectional view of the end cap of FIG. 4.
Figure 6:
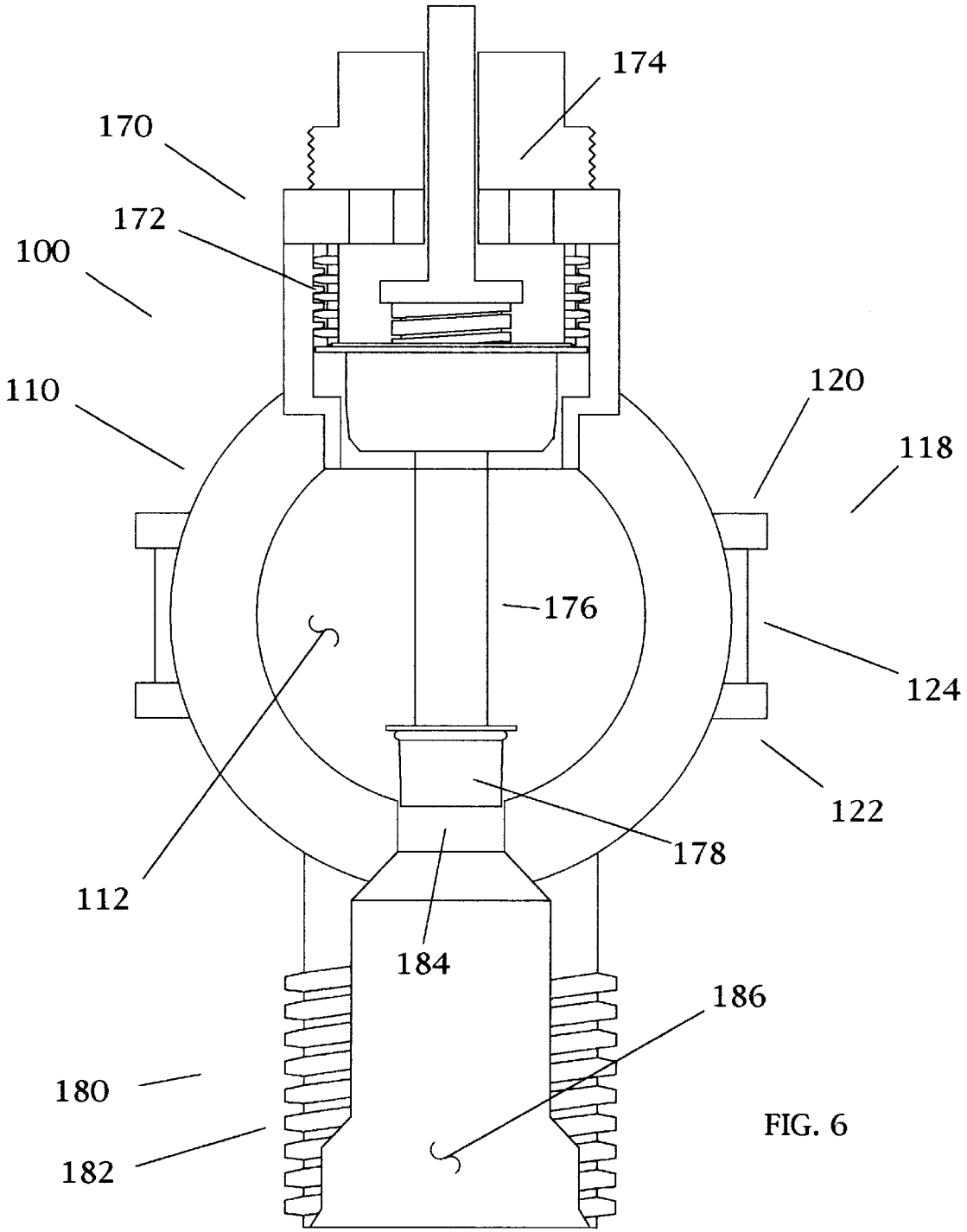
FIG. 6 is an enlarged end-view partial cross-sectional view of a version of the manifold segment of the invention, having a balancing head and shut-off shaft installed.

A closed end cap 600 allows the manifold to be terminated. The end cap of the preferred embodiment of the invention is seen in FIGS. 4 and 5. The end cap has a generally cylindrical body 610 and end plate 612. Internal threads 614 are sized to attach to the male connector end 140 of a manifold segment or the male coupling 350 of a cross tee. A locking rim 616 and locking stop 618 are similar in construction to the previously described locking rims. An annular grip 620 allows manual tightening of the end cap onto the cross tee or manifold segment.

Figure 14:
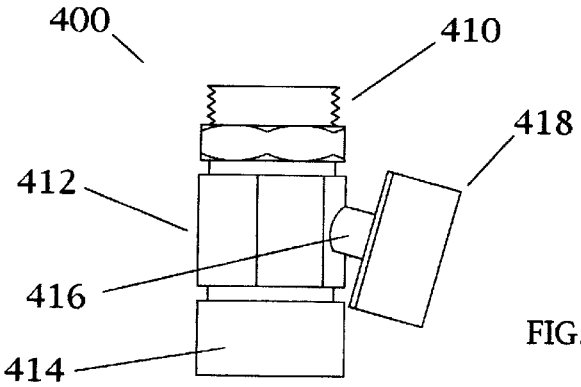
FIG. 14 is a side view of a version of the spigot adapted for use in the cross tee segment of FIGS. 11 and 12, adjacent to the thermometer of FIG. 13.
Figure 15:
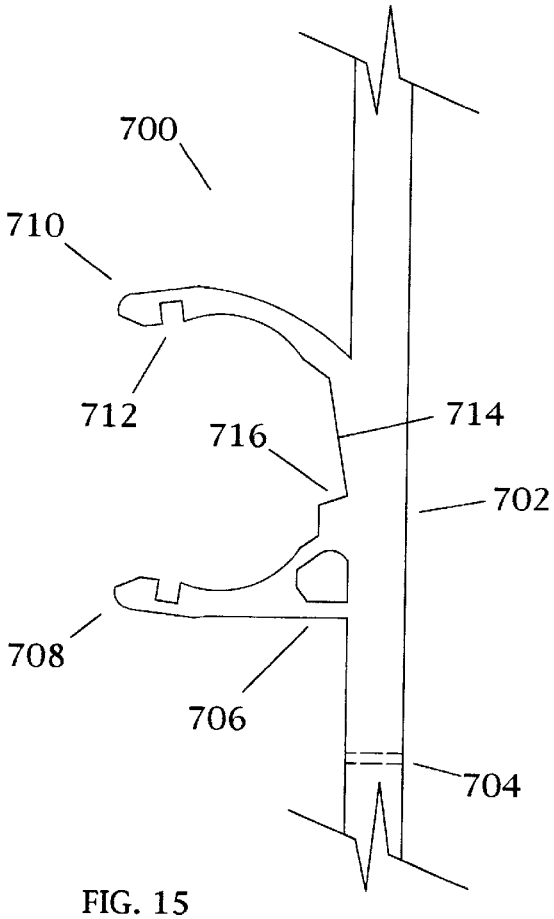
FIG. 15 is a version of the bracket adapted for use in supporting the manifold segment of FIG. 7.

As seen in FIGS. 14 and 15, two versions of a support bracket 700 adapted to engage the rails 114, 116 and 118 of the manifold segment are disclosed. Referring to FIG. 15, a first version of the support bracket provides a base 702 attachable to a supporting wall by means of mounting holes 704. A frame portion 706 extends from the base 702, and adds rigidity to the lower arm 708. The rigidity of the lower arm helps to better support the weight of the manifold, while the flexibility of the upper arm helps to better allow the manifold to snap in and out of the support bracket. The space between the arms is such that a supported manifold segment snaps into place between the arms, and is retained by friction. The upper and lower arms 710, 708 define a socket 712 which is sized to engage the upper and lower lower rails 114, 116 of a manifold segment 100. A notch 714, bounded on an upper edge by shoulder 716, is sized incrementally greater than the distance between the upper and lower side rails 120, 122, and contributes substantially to the frictional grip. It should be noted that the support bracket of FIG. 15 tends to support the manifold segments at a slight angle from vertical.

Figure 16:
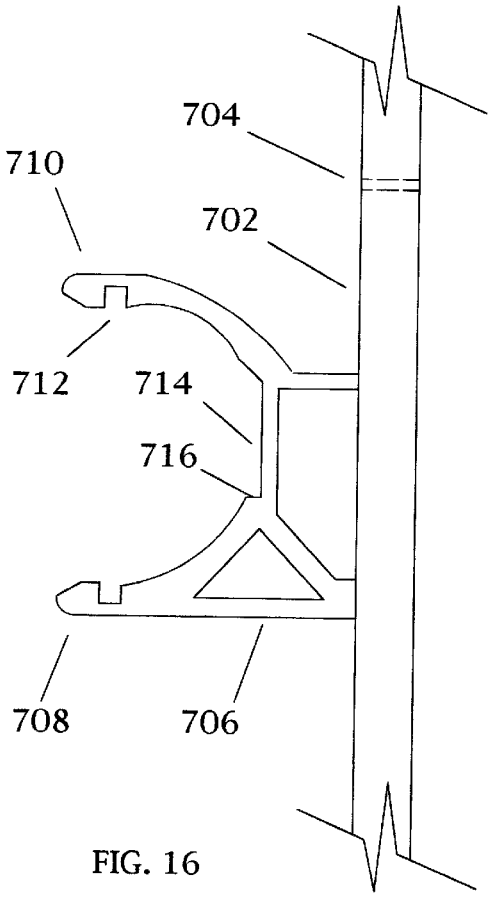
FIG. 16 is a second version of the bracket for use in supporting the manifold segment of FIG. 7.

Referring to FIG. 16, a second version of the support bracket 700 is seen. This bracket provides a vertically oriented notch 714 and horizontally oriented shoulder 716. As a result, the manifold segments are supported in an entirely vertical relationship with the supporting wall.

It is part of the very nature of the structure and practice invention that the basic components, the manifold segments 100, the thermometer unit 200, the cross tee pipe segment 300, the spigot 400, the open ended cap 500, the closed end cap 600 and the support bracket 700 can be assembled in a variety of quantities combinations and configurations. As a result, the invention may comprise a kit of parts for assembling a custom designed manifold, including the above basic components. A basic kit of parts, usable in the construction of a fluid-based heat-transfer system for space heating or for the supply and distribution of potable water, and other applications, may include at least one manifold segment, at least one cross tee segment, at least one spigot, at least one open ended cap, at least one closed ended pipe and at least one support bracket.

The water manifold is used in the construction of a fluid-based heat-transfer system for space heating, the supply and distribution of potable water, and other applications. The water manifold is formed from a number of elements in a flexible manner that must be determined according to an overall design plan. Once such a plan has been obtained, the support brackets 700 are appropriately fastened by means of mounting holes 704. A plurality of manifold segments are then assembled by means of the threaded connections or notched rib and mounting tab connectors. In a similar manner, one or more cross tee segments may be added to the manifold segments. A thermometer socket may be threaded into one of the threaded sockets 310 of the cross tee. Similarly, a spigot 400 may be threaded into one of the sockets 310. Unused sockets 310 are typically filled with socket plugs 312. In a typical application, an open end cap 500 is threaded onto the length of manifold and cross tee segments, thereby allowing metal pipe to be attached. A closed end cap 600 is typically installed, thereby closing the system.

The previously described versions of the present invention have many advantages, including a primary advantage of providing a novel water manifold, adapted primarily to heat transfer for space heating and to the supply and distribution of potable water, having a novel open ended cap that is formed from both brass and plastic bodies, thereby providing a transition between metallic pipe and plastic manifold segments.

Another advantage of the present invention is to provide a novel distribution header adapted primarily to heat transfer for space heating, wherein the brass body of the open ended cap provides anchoring ribs encased by the plastic body, thereby securely connecting the brass and plastic bodies.

Another advantage of the present invention is to provide a novel distribution header adapted primarily to heat transfer for space heating, wherein the manifold includes at least one manifold segment defining at least one rail on its outer surface for attachment to a supporting bracket.

Another advantage of the present invention is to provide a novel distribution header having a narrow structure suitable for mounting within a wall. A related advantage is that the manifold segments provide vertically oriented upper and lower male and female connectors, thereby better adapting the manifold to fit within a narrow space between adjacent walls.

Another advantage of the present invention is to provide a novel water manifold segment, cross tee segment, open-ended cap and closed end cap all of which provide a novel locking rim and locking stop which prevent over- or under-rotation, thereby aligning each segment with adjacent segments.

A still further advantage of the present invention is to provide a novel distribution header for potable water and hot water space heating having a novel cross tee segment supporting a thermometer and associated thermometer socket, while also supporting a spigot having a threaded spout and an associated valve.

A still further advantage of the present invention is to provide a novel distribution header for potable water and hot water space heating having a novel bracket adapted to engage rails formed in the surface of the water manifold segment.

A still further advantage of the present invention is to provide a plurality of interlocking components from which a novel distribution header may be assembled in a manner that is suited to the requirements of a specific application.

Although the present invention has been described in considerable detail and with reference to certain preferred versions, other versions are possible. For example, while many of the threaded connections of the above described parts are referred to as male or female, this is for illustrative purposes only, and in most cases these fittings could be reversed. Similarly, while two versions of the support bracket consistent with the practice of the invention have been illustrated, it is clear that other, similar, support brackets adaptable to the rails carried by the manifold segments could be developed. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A water manifold, comprising:

(A) an open ended cap, comprising:

(a) a metal body defining an internal channel; and (b) a plastic body partially enclosing the metal body, the plastic body defining an interior channel;

(B) At least one manifold segment, attached to the open ended cap, comprising:

(a) a tubular body having oppositely directed male and female threaded connector ends, each connector end having locking rim means and locking stop means for controlling the degree of rotation with respect to an adjacent threaded component;

(b) an upper threaded connector, perpendicular to the tubular body;

(c) a lower threaded connector, perpendicular to the tubular body; and (d) at least one rail, defined on an outer surface of the tubular body; and (C) a supporting bracket, grasping the at least one rail defined on the outer surface of the manifold segment, thereby supporting the manifold.

2. The water manifold of claim 1, additionally comprising:

(A) at least one cross tee segment, attached to the at least one manifold segment, comprising:

(a) a tubular body having oppositely directed male and female threaded connector ends; and (b) at least two threaded attachment fittings oriented perpendicularly to the length of the tubular body;

(B) A thermometer unit, attached to the cross tee segment, comprising:

(a) a face and rearwardly extending probe; and (b) a thermometer socket threadedly connected to a first threaded attachment fitting of the cross tee pipe segment; and (C) a spigot, carried adjacent to the thermometer unit by a second threaded attachment fitting on the cross tee segment, allows removal of fluid of a known temperature.

3. The water manifold of claim 1, wherein the open end cap additionally comprises:

(a) an O-ring slot, adjacent to an annular grip; and (b) a locking rim and locking stop, adjacent to an external threading.

4. A water manifold, comprising:

(A) an open ended cap, comprising:

(a) a metal body defining an internal channel, a portion of the internal channel defining internal threads, and an outer surface defining a hex sided surface and defining at least one anchoring rib;

(b) a plastic body partially enclosing the metal body and the at least one anchoring rib, the plastic body defining an interior channel and an outside surface having an annular grip, the annular grip adjacent to the hex sided surface of the metal body, and defining an O-ring slot, adjacent to the annular grip, and defining external threading, adjacent to the O-ring slot, and defining a locking rim and locking stop, adjacent to the external threading;

(B) At least one manifold segment, attached to the open ended cap, comprising:

(a) a tubular body having oppositely directed male and female threaded connector ends, each connector end having a locking rim and a locking stop to control the degree of rotation with respect to an adjacent threaded component;

(b) an upper threaded connector, perpendicular to the tubular body;

(c) a lower threaded connector, perpendicular to the tubular body; and (d) at least one rail, defined on an outer surface of the tubular body;

(C) at least one cross tee segment, attached to the at least one manifold segment, comprising:

(a) a tubular body having oppositely directed male and female threaded connector ends, each connector end having a locking rim and a locking stop to control the degree of rotation with respect to an adjacent threaded component; and (b) at least two threaded attachment fittings oriented perpendicularly to the length of the tubular body;

(D) A thermometer unit, attached to the cross tee segment, comprising:

(a) a face and rearwardly extending probe; and (b) a thermometer socket threadedly connected to a first threaded attachment fitting of the cross tee pipe segment;

(E) a spigot, carried adjacent to the thermometer unit by a second threaded attachment fitting on the cross tee segment, allows removal of fluid of a known temperature; and (F) a supporting bracket, grasping the at least one rail of the manifold segment, thereby supporting the manifold.

5. A kit of parts for assembling a manifold, comprising:

(A) an open ended cap, comprising a metal body defining an interior channel and a threaded attachment surface and a plastic body, partially enclosing the metal body, also defining an interior channel and a threaded attachment surface;

(B) at least one manifold segment, attachable to the open ended cap, comprising a tubular body having oppositely directed male and female threaded connector ends, an outer surface of the tubular body defining upper and lower rails and a pair of side rails;

(C) at least one cross tee segment, attachable to the at least one manifold segment, comprising a tubular body having oppositely directed male and female threaded connector ends, and four threaded sockets radially arrayed about the tube body, perpendicular to the tubular body;

(D) a thermometer unit, attachable to the cross tee segment, comprising a thermometer face and rearwardly extending probe, the probe carried by a thermometer socket threadedly connectable to one of the four threaded sockets of the cross tee segment;

(E) a spigot, carried adjacent to the thermometer unit by a second of said four threaded sockets on the cross tee segment, allows removal of fluid of a known temperature; and (F) a supporting bracket, adapted to grasp one or more of the rails of the at least one manifold segment, thereby supporting the manifold.

* * * * *